US011910825B2

(12) United States Patent
Liu

(10) Patent No.: US 11,910,825 B2
(45) Date of Patent: Feb. 27, 2024

(54) ELECTRONIC CIGARETTE

(71) Applicant: Shenzhen Eigate Technology Co., Ltd., Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 581 days.

(21) Appl. No.: 17/129,975

(22) Filed: Dec. 22, 2020

(65) Prior Publication Data

US 2021/0401036 A1 Dec. 30, 2021

(30) Foreign Application Priority Data

Jun. 29, 2020 (CN) ..... 202010605449.6
Aug. 25, 2020 (CN) ..... 202021803902.6

(51) Int. Cl.

| | |
|---|---|
| ***A24F 40/10*** | (2020.01) |
| ***A24F 40/42*** | (2020.01) |
| ***A24F 40/46*** | (2020.01) |
| ***A24F 40/50*** | (2020.01) |
| ***A24F 40/465*** | (2020.01) |

(52) U.S. Cl.
CPC ..... *A24F 40/10* (2020.01); *A24F 40/42* (2020.01); *A24F 40/465* (2020.01)

(58) Field of Classification Search
CPC ..... A24F 40/10; A24F 40/42; A24F 40/465; A24F 40/46
See application file for complete search history.

(56) References Cited

U.S. PATENT DOCUMENTS

2013/0160765 A1* 6/2013 Liu ..... A61M 15/06 128/202.21
2018/0279672 A1* 10/2018 Davis et al. ..... A24F 47/008

* cited by examiner

*Primary Examiner* — Michael J Felton
*Assistant Examiner* — Ronnie Kirby Jordan
(74) *Attorney, Agent, or Firm* — MATTHIAS SCHOLL P.C.; Matthias Scholl

(57) ABSTRACT

An electronic cigarette includes a preheater. The preheater includes an e-liquid tank and a heating wire disposed in the e-liquid tank. In a power-on state, the heating wire produces heat.

8 Claims, 5 Drawing Sheets

ELECTRONIC CIGARETTE

CROSS-REFERENCE TO RELATED APPLICATIONS

Pursuant to 35 U.S.C. § 119 and the Paris Convention Treaty, this application claims foreign priority to Chinese Patent Application No. 202010605449.6 filed on Jun. 29, 2020, and to Chinese Patent Application No. 202021803902.6 filed on Aug. 25, 2020. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

The disclosure relates to an electronic cigarette.

Conventionally, the e-liquid in an electronic cigarette is directly heated and vaporized in the inhaling process, without a preheating process. In cold conditions, for example, in winter, the e-liquid tends to solidify into paste and thus blocks the passage of the e-liquid.

SUMMARY

The disclosure provides an electronic cigarette, comprising a preheater; the preheater comprises an e-liquid tank and a heating wire disposed in the e-liquid tank; in a power-on state, the heating wire produces heat.

In a class of this embodiment, the electronic cigarette further comprises a ceramic core configured to atomize e-liquid flowing through the ceramic core in the power-on state.

In a class of this embodiment, the preheater further comprises an air duct and a contact pin; the air duct and the heating wire are disposed in the contact pin; the contact pin is disposed in the e-liquid tank; and air of the e-liquid tank flows in the air duct.

In a class of this embodiment, the preheater further comprises a pinhead, a silicone gasket, and a Teflon® (polytetrafluoroethylene (PTFE)) tube; the Teflon® (PTFE) tube is disposed around the heating wire for insulation; the pinhead is disposed on the contact pin and communicates with the e-liquid tank; and the silicone gasket is disposed around the air duct.

In a class of this embodiment, the e-liquid tank comprises glass with a scale.

In a class of this embodiment, the electronic cigarette further comprises a silicone base and an atomization base; the ceramic core is fixed in the silicone base, and the silicone base is fixed in the atomization base.

In a class of this embodiment, the ceramic core is replaced by glass, quartz, crystal, agate, jade, or mica and is transversely or longitudinally rotatably fixed on the silicone base.

In a class of this embodiment, the electronic cigarette further comprises an outer insulation ring, an outer joint, an inner insulation ring, an inner joint; the outer insulation ring is disposed on a bottom end of the atomization base to electrically insulate positive and negative terminals of the heating wire; the outer joint is disposed in the outer insulation ring and contacts the positive and negative terminals of the heating wire; the inner insulation ring is disposed in the outer joint to electrically insulate positive and negative terminals of the ceramic core; and the inner joint is disposed in the inner insulation ring and contacts the positive and negative terminals of the ceramic core.

In a class of this embodiment, the electronic cigarette further comprises a battery assembly; the battery assembly comprises a control unit, a power button, and a warm-up button; the control unit is configured to control preheating and atomization of e-liquid through pressing the power button or the warm-up button.

In a class of this embodiment, the control unit further comprises an igniting plate and a control panel; the power button is disposed on the igniting plate; the warm-up button is disposed on the control panel; the ceramic core is controlled by a circuit of the igniting plate; and the heating wire is controlled by a circuit of the control panel.

DETAILED DESCRIPTION

To further illustrate, embodiments detailing an electronic cigarette are described below. It should be noted that the following embodiments are intended to describe and not to limit the disclosure.

Tobacco materials refer to tobacco tar, tobacco paste, tobacco leaf and other materials used to produce smoke.

Figure 1:
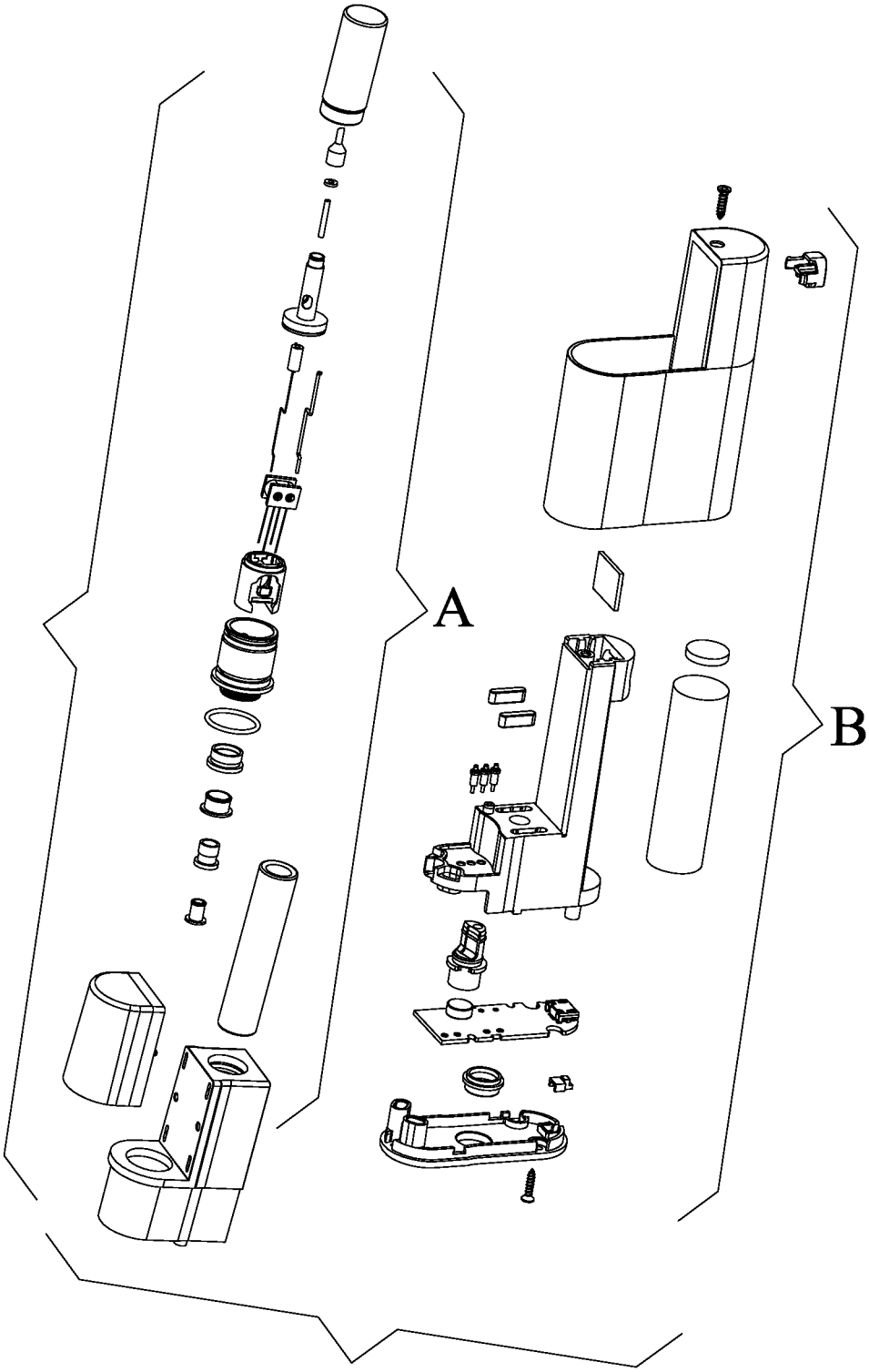
FIG. 1 is an exploded view of an electronic cigarette in accordance with one embodiment of the disclosure.
Figure 2:
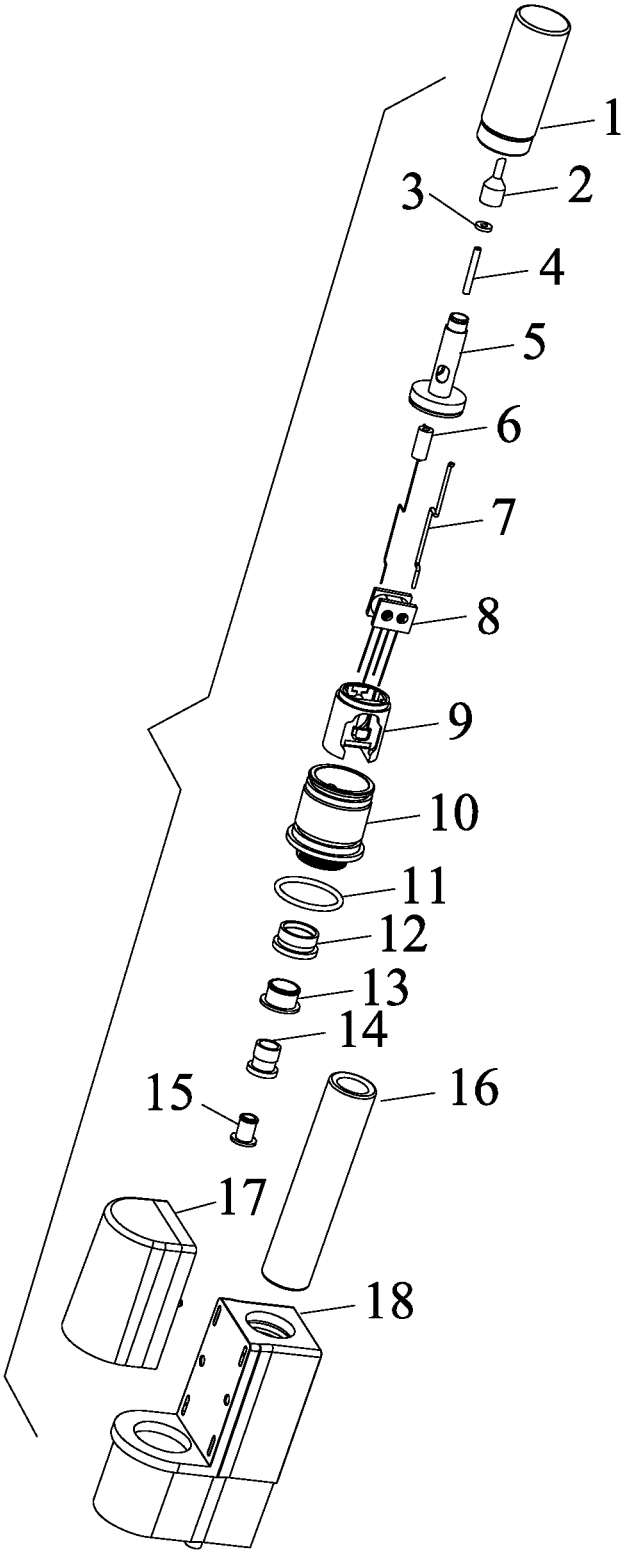
FIG. 2 is an exploded view of an electronic cigarette in accordance with one embodiment of the disclosure.
Figure 3:
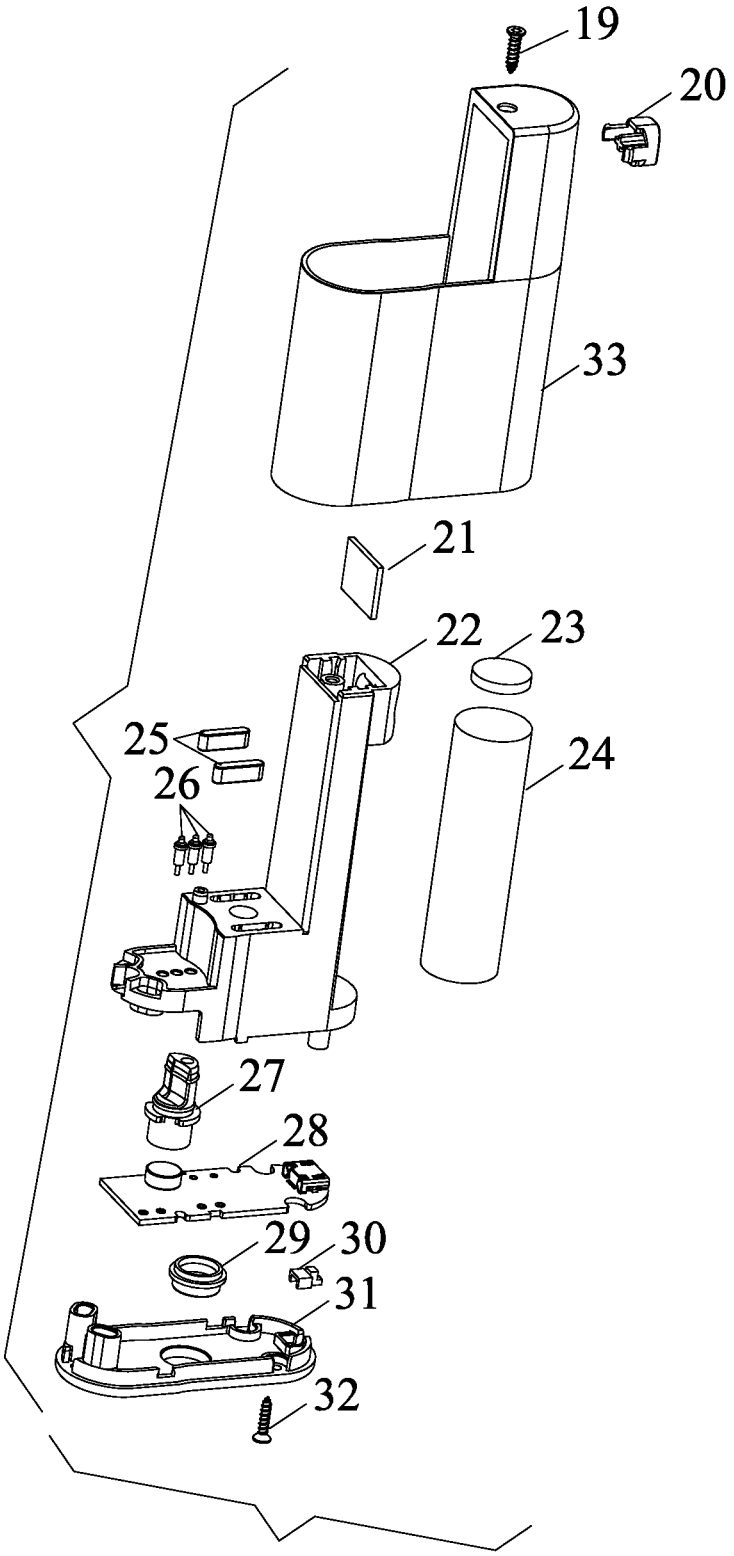
FIG. 3 is an exploded view of a battery assembly of an atomization assembly of an electronic cigarette in accordance with one embodiment of the disclosure.
Figure 4:
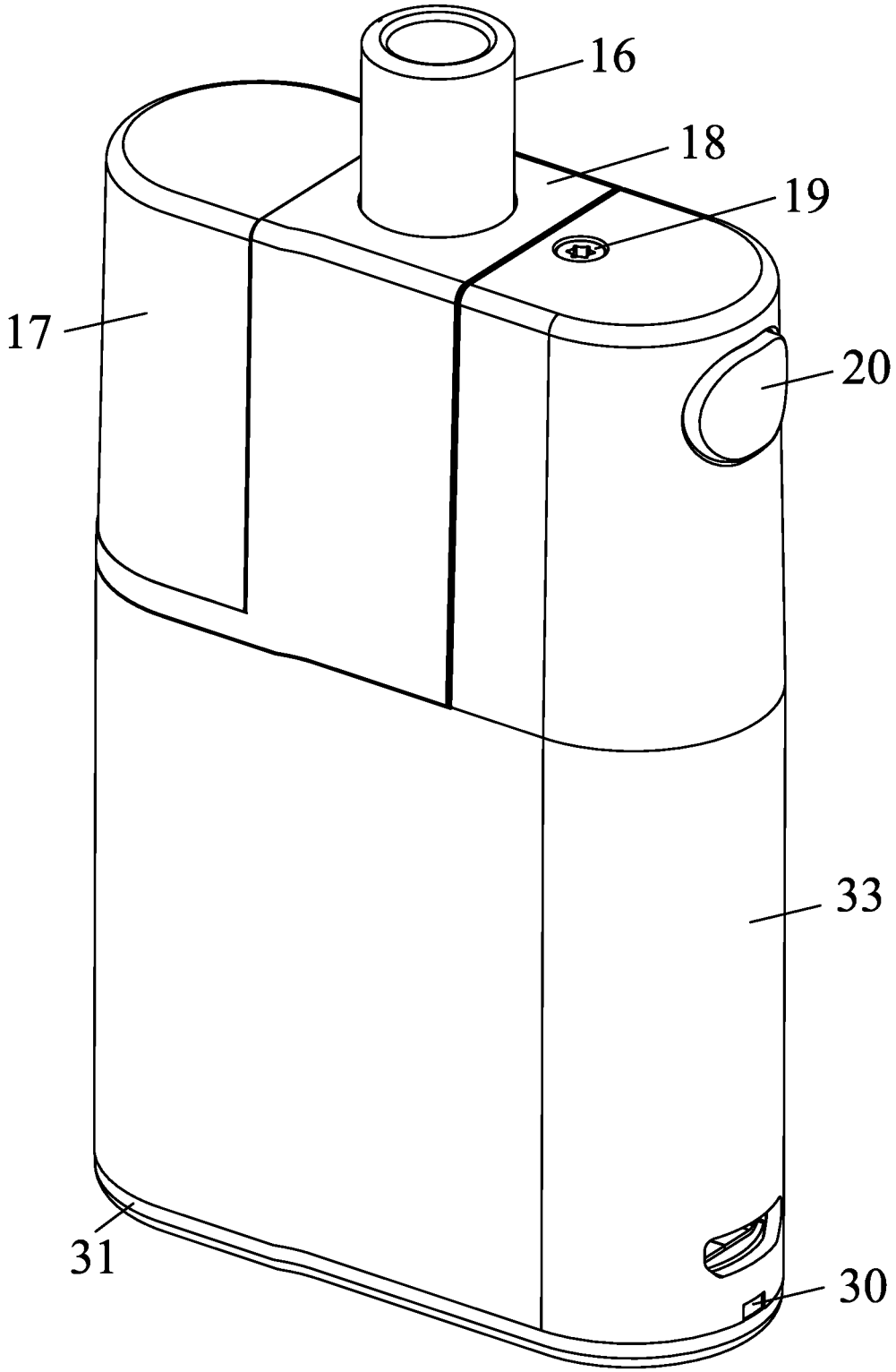
FIG. 4 is a schematic diagram of an electronic cigarette in accordance with one embodiment of the disclosure.
Figure 5:
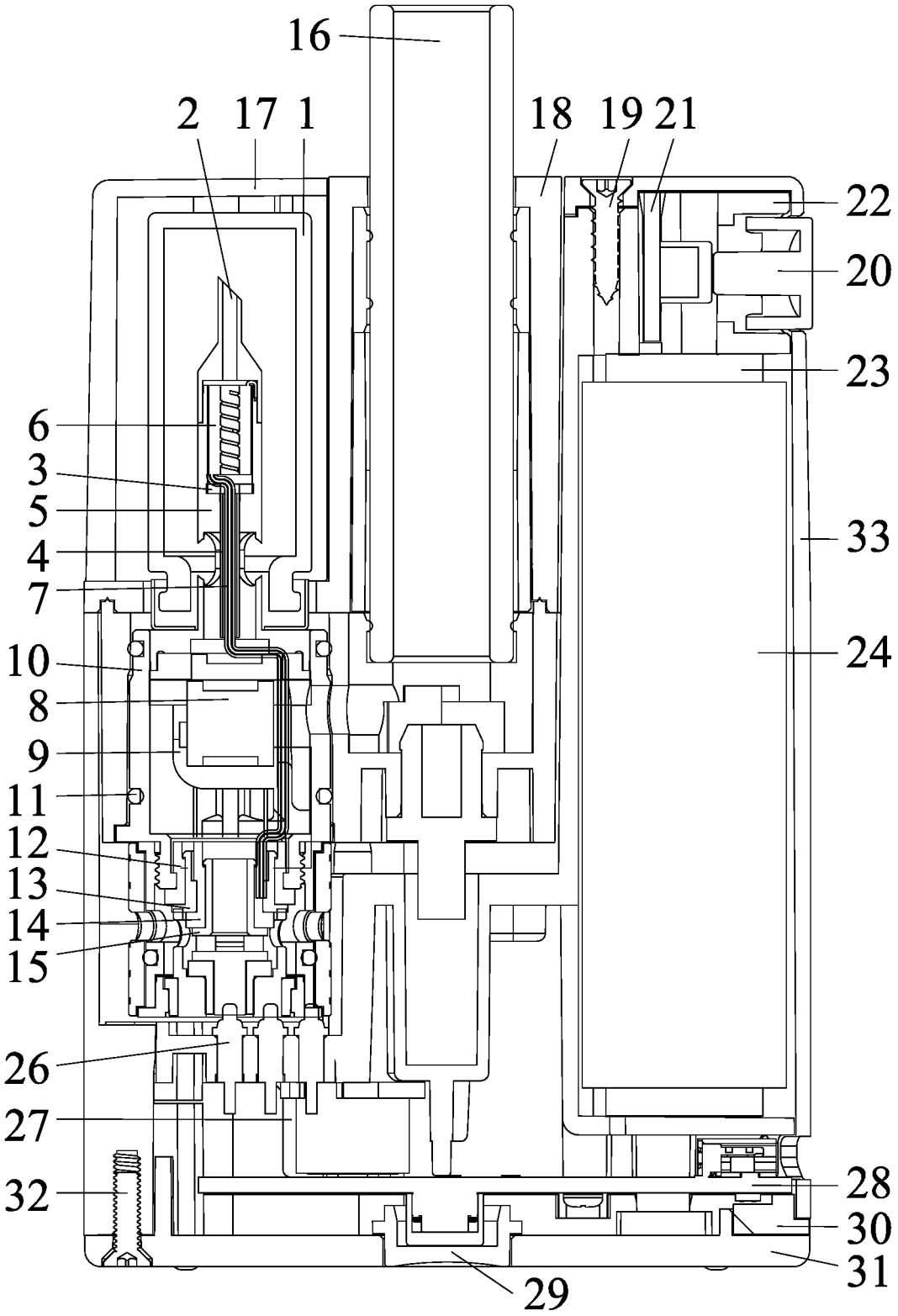
FIG. 5 is a sectional view of an electronic cigarette in accordance with one embodiment of the disclosure.

As shown in FIGS. 1-5, the disclosure provides an electronic cigarette comprising an atomization assembly A and a battery assembly B connected to the atomization assembly. The atomization assembly A comprises an e-liquid tank 1, a pinhead 2, a silicone gasket 3, an air duct 4, a contact pin 5, a heating wire 6, a Teflon® (PTFE) tube 7, a ceramic core 8, a silicone base 9, an atomization base 10, a seal ring 11, an outer insulation ring 12, an outer joint 13, an inner insulation ring 14, an inner joint 15, a mouthpiece 16, a cover 17, and a casing 18. The e-liquid tank 1 is sealed with silica gel and aluminum foil. When in use, the contact pin 5 is inserted into the e-liquid tank 1. The Teflon® (PTFE) tube 7 is disposed around the heating wire 6 for insulation. The heating wire 6 is fixed in the contact pin 5 to preheat thick or paste e-liquid in the e-liquid tank 1 to a fluid. The pinhead 2 is disposed on the contact pin 5 and communicates with the e-liquid tank 1. The silicone gasket 3 is disposed around the air duct 4. The air duct 4 is disposed in the contact pin 5. When the e-liquid in the e-liquid tank 1 flows in the contact pin 5, the air of the e-liquid tank 1 circulates in the air duct 4. The ceramic core 8 is fixed in the silicone base 9. The contact pin 5 is disposed on the silicone base 9 for e-liquid permeation. The e-liquid fluid flows to the ceramic core and atomized. The silicone base 9 is fixed in the atomization base 10. The seal ring 11 is disposed on the atomization base 10. The outer insulation ring 12 is disposed on the bottom end of the atomization base 10 to electrically insulate the positive and negative terminals of the heating wire 6. The outer joint 13 is disposed in the outer insulation ring 12 and contacts the positive and negative terminals of the heating wire 6. The inner insulation ring 14 is disposed in the outer joint 13 to electrically insulate the positive and negative terminals of the ceramic core 8. The inner joint 15 is disposed in the inner insulation ring 14 and contacts the positive and negative terminals of the ceramic core 8. The atomization base 10 is fixed in the casing 18. The mouthpiece 16 is disposed in the casing 18. The cover 17 covers the e-liquid tank 1 disposed on one side of the casing 18.

The battery assembly B comprises a first screw 19, a power button 20, an igniting plate 21, a support 22, an ethylene vinyl acetate gasket 23, a battery 24, a magnet 25, an electrode 26, a silicone sleeve 27, a control panel 28, a warm-up button 29, a light guide 30, a bottom cover 31, a second screw 32, and a housing 33. The igniting plate 21 is fixed in the top end of the support 22. The lead of the igniting plate 21 is soldered on the control circuit of the control panel 28. The power button 20 is disposed on the igniting plate 21. The input terminal of the control panel 28 is soldered on the positive and negative terminals of the battery 24. The ethylene vinyl acetate gasket 23 is attached to the positive and negative terminals of the battery 24 for electric insulation. The battery 24 is fixed in the support 22. The electrode 26 is fixed on the support 22. The magnet 25 is fixed in the support 22. The output terminal of the control panel 28 is soldered on the electrode 26 and contacts a preheater. The light guide 30 is disposed on the bottom cover 31. The silicone sleeve 27 is disposed on a pneumatic switch of the control panel 28. The warm-up button 29 is disposed on the control panel 28. The control panel 28 is fixed on the bottom end of the support 22. The support 22 is fixed in the housing 33 through the first screw 19. The bottom cover 31 is fixed on the bottom end of the housing 33 via the second screw 32. The atomization assembly is connected to the battery assembly through the magnetic force of the magnet 25. The electrode 26 is electrically connected to the outer joint 13, the inner joint 15, and the atomization base 10 of the preheater for preheating and atomization of e-liquid.

In certain embodiments, the ceramic core 8 is I-shaped and comprises two round holes. The heating wire is disposed in the two round holes and the pin of the heating wire extends out of the round holes. The ceramic core 8 is transversely disposed on the silicone base 9.

In certain embodiments, the ceramic core 8 is replaced by glass, quartz, crystal, agate, jade, or mica and is transversely or longitudinally rotatably fixed on the silicone base 9. The ceramic core 8 is in the shape of a cuboid, cube, or polygon. The ceramic core 8 comprises more than one round hole, square hole, elliptical hole, or a combination thereof. The shape and number of the heating wire in the ceramic core is arbitrary.

The following advantages are associated with the electronic cigarette of the disclosure:

1. The electronic cigarette comprises a preheater configured to preheat thick or paste e-liquid in the e-liquid tank to a fluid. The design can prevent condensed e-liquid from blocking the e-liquid outlet.

2. The preheater comprises an e-liquid tank with a scale and sealed by with silica gel and aluminum foil. When in use, the contact pin is inserted into the e-liquid tank and the e-liquid flows out. It is easy to operate.

3. The electronic cigarette comprises two control circuits to control the preheating and atomization of e-liquid simultaneously or separately.

It will be obvious to those skilled in the art that changes and modifications may be made, and therefore, the aim in the appended claims is to cover all such changes and modifications.

What is claimed is:

1. An electronic cigarette, comprising a preheater and a ceramic core; wherein:

the preheater comprises an e-liquid tank and a heating wire disposed in the e-liquid tank; in a power-on state, the heating wire produces heat;

the ceramic core is configured to atomize e-liquid flowing through the ceramic core in the power-on state; and the preheater further comprises an air duct and a contact pin; the air duct and the heating wire are disposed in the contact pin; the contact pin is disposed in the e-liquid tank; and air of the e-liquid tank flows in the air duct.

2. The electronic cigarette of claim 1, wherein the preheater further comprises a pinhead, a silicone gasket, and a polytetrafluoroethylene tube; the polytetrafluoroethylene tube is disposed around the heating wire for insulation; the pinhead is disposed on the contact pin and communicates with the e-liquid tank; and the silicone gasket is disposed around the air duct.

3. The electronic cigarette of claim 2, wherein the e-liquid tank comprises glass.

4. The electronic cigarette of claim 3, further comprising a silicone base and an atomization base; wherein the ceramic core is fixed in the silicone base, and the silicone base is fixed in the atomization base.

5. The electronic cigarette of claim 4, wherein the ceramic core is replaced by glass, quartz, crystal, agate, jade, or mica and is transversely or longitudinally rotatably fixed on the silicone base.

6. The electronic cigarette of claim 5, further comprising an outer insulation ring, an outer joint, an inner insulation ring, an inner joint, wherein the outer insulation ring is disposed on a bottom end of the atomization base to electrically insulate positive and negative terminals of the heating wire; the outer joint is disposed in the outer insulation ring and contacts the positive and negative terminals of the heating wire; the inner insulation ring is disposed in the outer joint to electrically insulate positive and negative terminals of the ceramic core; and the inner joint is disposed in the inner insulation ring and contacts the positive and negative terminals of the ceramic core.

7. The electronic cigarette of claim 6, further comprising a battery assembly, wherein the battery assembly comprises a control unit, a power button, and a warm-up button; the control unit is configured to control preheating and atomization of e-liquid through pressing the power button or the warm-up button.

8. The electronic cigarette of claim 7, wherein the control unit further comprises an igniting plate and a control panel; the power button is disposed on the igniting plate; the warm-up button is disposed on the control panel; the ceramic core is controlled by a circuit of the igniting plate; and the heating wire is controlled by a circuit of the control panel.

* * * * *